US005123897A

United States Patent [19]

Hackenberg et al.

[11] Patent Number: 5,123,897

[45] Date of Patent: Jun. 23, 1992

[54] RECIPIENT OR HOUSING FOR A GAS ULTRACENTRIFUGE

[75] Inventors: Rudolf Hackenberg, Langerwehe; Wolfgang Ebert, Jülich, both of Fed. Rep. of Germany

[73] Assignee: Uranit GmbH, Jülich, Fed. Rep. of Germany

[21] Appl. No.: 739,666

[22] Filed: Mar. 8, 1985

[30] Foreign Application Priority Data

May 4, 1984 [DE] Fed. Rep. of Germany ..... 3416453

[51] Int. Cl.[5] ..... B04B 9/14

[52] U.S. Cl. ..... 494/82; 248/548; 248/612

[58] Field of Search ..... 494/82; 248/612, 548

[56] References Cited

U.S. PATENT DOCUMENTS 2,827,229 3/1958 Blum ..... 494/82 X
3,151,074 9/1964 Gooch ..... 494/82 X
3,289,925 12/1966 Zippe et al. ..... 494/82 X
4,283,004 8/1981 Lamadrid ..... 494/82 X

FOREIGN PATENT DOCUMENTS 22529 6/1948 Finland ..... 494/82

*Primary Examiner*—John S. Maples
*Attorney, Agent, or Firm*—Spencer & Frank

[57] ABSTRACT

A recipient for a gas ultracentrifuge which comprises an oblong cylindrical shell having a lid closing each end, a base flange having an upper end surrounding one end of the shell and a plastically deformable ring interposed between the base flange and the shell. In an embodiment of the invention, the plastically deformable ring comprises a ring-shaped section and a welding shoulder which forms a ring-shaped collar integral with the base flange, the thickness of the shell being greater than that of the ring-shaped collar and about the same thickness as that of the welding shoulder.

4 Claims, 1 Drawing Sheet

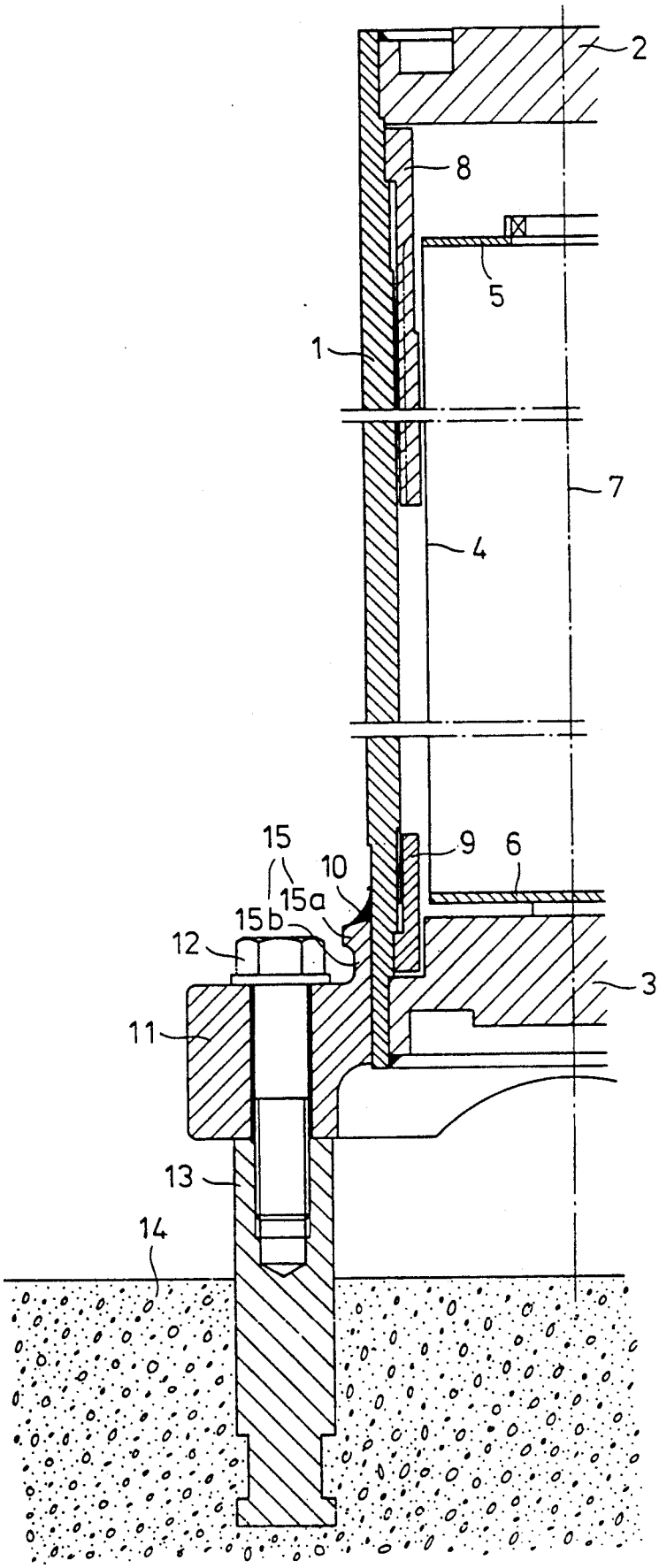
2
8
5
1
7
4
15
9
6
10
15a
15b
12
3
11
13
14

RECIPIENT OR HOUSING FOR A GAS ULTRACENTRIFUGE

BACKGROUND OF THE INVENTION

The present invention relates to a recipient or housing for a gas ultracentrifuge.

The recipient for a gas ultracentrifuge constitutes a housing for a rotor spinning about a perpendicular axis, including a drive, the bearings and a gas intake and gas outlet systems. At the same time, it serves as a vacuum vessel and provides protection against rotor chips and fragment freely flying about in case of rotor destruction. The connection to the concrete foundation of the building is established through a base flange bolted to anchor bolts cast in the foundation. This base flange normally is welded to the cylindrical shell of the recipient. Like a gyro, the bottom end of the rotor is supported by a calotte-shaped needle bearing, the top end being centered by a magnetic bearing (see, e.g., DE-PS 1,071,593 and the corresponding U.S. Pat. No. 3,289,925). If such a rotor spinning at extremely high speeds were to be destroyed because of an imbalance or for other reasons, it would hit the shell of the recipient with great impact. The spin inherent in the rotor in this case would be passed through the recipient shell, the welding seam of the base flange, the base flange, the connecting bolts and the anchor bolts into the concrete foundation of the building. The crashing moment produced in this case is extremely high because of the abruptness of the crash and the high stiffness of the recipient shell and its fastening elements. Consequently, also the torsional load acting on the welding seam connecting the base flange and the recipient shell, and the shear force and the bending moment acting on the attachment bolts, are very high. Fracture of this welding seam or the fastening elements can lead to severe, undesired consequences, such as the ingress of air into the recipient or shaking and crashing of the rotors of adjacent centrifuges.

SUMMARY OF THE INVENTION

The present invention is based on the problem of designing a recipient for a gas ultracentrifuge in such a way that the shear stresses occurring in case of rotor destruction in the welding seam connecting the recipient shell and the base flange and in the fastening elements, respectively, remain below the permissible load and stress limits.

In accordance with the invention, there is provided a recipient or housing for a gas ultracentrifuge which comprises an oblong cylindrical shell having a lid closing each end, a base flange having an upper end surrounding one end of the shell and a plastically deformable ring interposed between the base flange and the shell. In an embodiment of the invention, the plastically deformable ring comprises a ring-shaped section and a welding shoulder which forms a ring-shaped collar integral with the base flange, the thickness of the shell being greater than that of the ring-shaped collar and about the same thickness as that of the welding shoulder.

As the polar resistance moment of the interposed ring is much lower than that of the recipient, the ring will be deformed plastically, thus limiting the amount of the torsional moment during rotor destruction while, at the same time, absorbing part of the energy. In this way, mainly the load acting on the welding seam and in the fastening elements will be reduced appropriately and overloading will be prevented.

BRIEF DESCRIPTION OF THE DRAWING

The figure shows a schematic longitudinal section through a recipient of a gas ultracentrifuge for the separation of uranium isotopes.

DESCRIPTION OF THE PREFERRED EMBODIMENT

Referring to the drawing, the recipient essentially consists of an oblong, cylindrical shell 1 having first and second end, lids 2 and 3 being welded in a gastight relationship to each of the respective ends of the cylinder. Inside the recipient there is a rotor 4, which is fitted with a top lid 5 and a bottom lid 6. When in operation, the rotor spins at high speed about a perpendicular axis 7, which also constitutes he longitudinal axis of the shell 1. The space between the rotor and the recipient is evacuated in this case. The recipient moreover contains two tubular nozzles 8, 9 which provide protection against fragments, which nozzles each cover the areas of the two rotor lids 5, 6.

The bottom end of the recipient shell 1 is connected to a base flange 11 by a welding seam 10. The base flange 11 is bolted onto anchor bolts 13 by means of several bolts 12 distributed about the circumference of the flange, which anchor bolts are cast in the concrete foundation 14.

The base flange 11 surrounding the recipient shell 1 has a collar 15 of the shape of a cylindrical ring facing upward, the free front end of which is designed as a welding shoulder **15*a*. The radial and axial extensions of this welding shoulder 15*a* are matched to the wall thickness of the recipient shell 1 in view of the welding seam 10. The welding shoulder 15*a* is followed by a section 15*b* of the shape of a cylindrical ring acting as a "yielding joint", whose wall thickness is less than that of the shell and which, therefore, has a much lower polar resistance moment with respect to the axis 7. The shell 1 and the base flange 11, including the collar 15**, are made of light metal, preferably of an aluminum alloy.

The optimum dimensions of this section **15*b***, which limits the torsional moment during destruction, can be determined for each individual case both by computation and experimentally on the basis of the design and operating parameters of the respective type of centrifuge. The important aspect is that there be plastic deformation which, however; must not lead up to material fracture.

By means of this measure according to the present invention it is thus also possible to control a major accident, such as the destruction of a rotor, to such an extent that an ingress of air into the recipient or shaking of adjacent centrifuges is avoided, thus preventing consequential damage that could impair the overall operation of a centrifuge enrichment plant.

Of course, the yielding joint serving to limit the torsional moment can be implemented also in a single-unit recipient without a welding seam between the base flange and the shell, in order to minimize the loads and stresses introduced into the fastening elements and limit their magnitudes.

We claim:

1. A protective recipient for completely enclosing the rotor of a gas ultracentrifuge to contain said rotor within said recipient in the event said rotor is subjected to excessive forces during a malfunction of said ultracentrifuge, said recipient being mounted on a foundation, comprising:

an oblong cylindrical shell having first and second ends, each of said ends being closed by a lid secured thereto;

a base flange having a collar portion at an upper end thereof surrounding and affixed to one end of said cylindrical shell, said collar portion including a plastically deformable ring which is deformed plastically when acted upon by a torsional load caused by excessive forces acting on said rotor thereby preventing the stresses in said recipient from exceeding a predetermined value, said base flange further having a lower end anchored to said foundation, whereby said base flange is the sole support for said cylindrical shell.

2. A recipient as defined by claim 1 wherein said cylindrical shell, base flange and plastically deformable ring are made of a light alloy.

3. A protective recipient for completely enclosing the rotor of a gas ultracentrifuge to contain said rotor within said recipient in the event said rotor is subjected to excessive forces during a malfunction of said ultracentrifuge, said recipient being mounted on a foundation, comprising an oblong cylindrical shell having a predetermined thickness and first and second ends, each of said ends being closed by a lid secured thereto;

a base flange having a collar portion at an upper end thereof surrounding one end of said cylindrical shell, the collar portion of said base flange including a plastically deformable ring-shaped section having a wall thickness less than the thickness of said cylindrical shell; and a welding shoulder affixed to said collar portion and having a wall thickness approximately corresponding tot he thickness of said cylindrical shell, said base flange further having a lower end anchored to said foundation whereby said base flange is the sole support for said cylindrical shell; and means for attaching said welding shoulder to said one end of said cylindrical shell, whereby said ring-shaped section is deformed plastically when acted upon by a torsional load, caused by excessive forces acting on said rotor, which exceeds a predetermined value.

4. A recipient as defined by claim 3 wherein said cylindrical shell and base flange are made of a light alloy.

* * * * *